US010429043B2

(12) United States Patent
Mata

(10) Patent No.: US 10,429,043 B2
(45) Date of Patent: Oct. 1, 2019

(54) STAND FOR ELONGATED LIGHTING APPARATUS

(71) Applicant: Feit Electric Company, Inc., Pico Rivera, CA (US)

(72) Inventor: Jose Mata, La Puente, CA (US)

(73) Assignee: Feit Electric Company, Inc., Pico Rivera, CA (US)

( * ) Notice: Subject to any disclaimer, the term of this patent is extended or adjusted under 35 U.S.C. 154(b) by 158 days.

(21) Appl. No.: 14/979,858

(22) Filed: Dec. 28, 2015

(65) Prior Publication Data

US 2016/0209014 A1 Jul. 21, 2016

Related U.S. Application Data

(60) Provisional application No. 62/105,408, filed on Jan. 20, 2015.

(51) Int. Cl.

| | |
|---|---|
| ***F21V 21/08*** | (2006.01) |
| ***F21S 6/00*** | (2006.01) |
| ***F21S 8/06*** | (2006.01) |
| ***F21V 21/06*** | (2006.01) |
| *F21Y 103/00* | (2016.01) |

(52) U.S. Cl.

CPC ..... *F21V 21/08* (2013.01); *F21S 6/00* (2013.01); *F21S 8/061* (2013.01); *F21V 21/06* (2013.01); *F21Y 2103/00* (2013.01)

(58) Field of Classification Search

CPC .... F21V 21/06; F21V 21/08; F21S 8/03–033; F21S 8/061

USPC ..... 248/133, 128, 538, 346.5, 346.05, 520, 248/151; 362/217.14–217.17, 431

See application file for complete search history.

(56) References Cited

U.S. PATENT DOCUMENTS

| | | | | | |
|---|---|---|---|---|---|
| 2,049,407 | A | * | 7/1936 | Clark | B60Q 7/005 102/343 |
| 2,070,882 | A | * | 2/1937 | Brown | B61L 5/125 102/344 |
| 2,853,261 | A | * | 9/1958 | Loeb | A47G 23/0216 248/151 |
| 3,517,184 | A | * | 6/1970 | Hale | B63B 45/00 285/303 |
| 3,805,053 | A | * | 4/1974 | Julinot | F21S 8/00 362/223 |
| D255,259 | S | * | 6/1980 | Nelson | D22/147 |
| 4,337,503 | A | * | 6/1982 | Turner | B62J 6/00 362/191 |
| 4,551,939 | A | * | 11/1985 | Kitchens | A01K 97/10 248/513 |

(Continued)

FOREIGN PATENT DOCUMENTS

DE 102012021918 A1 * 5/2014 ..... F21V 21/06

*Primary Examiner* — Julie A Bannan

(74) *Attorney, Agent, or Firm* — Alston & Bird LLP

(57) ABSTRACT

In various embodiments, a portable support stand for supporting an elongated luminaire, a luminaire structure for supporting a luminaire on a support surface, and associated methods are provided. In an example embodiment, a portable support stand comprises a base portion configured to be positioned on a support surface and a luminaire holster detachably coupled to the base portion. The luminaire holster is configured to receive an elongated luminaire therein and to support the elongated luminaire in a fixed orientation relative to the support surface.

20 Claims, 10 Drawing Sheets

(56) References Cited

U.S. PATENT DOCUMENTS 4,803,794 A * 2/1989 Lopez ..... A01K 97/10 248/538
4,907,769 A * 3/1990 Hunley, Jr. ..... F21V 21/06 248/122.1
5,001,614 A * 3/1991 Buss ..... F21S 6/005 362/225
5,278,735 A * 1/1994 Her ..... B60Q 7/02 362/397
5,339,225 A * 8/1994 Wiggerman ..... B63B 45/04 362/235
5,436,815 A * 7/1995 Grooms ..... F21L 14/026 362/216
D370,072 S * 5/1996 Arden ..... D26/110
5,588,630 A * 12/1996 Chen-Chao ..... F16C 11/10 248/514
5,816,684 A * 10/1998 Yu ..... F21V 21/145 362/191
5,954,426 A * 9/1999 Whittington ..... F21V 21/06 362/410
6,502,954 B1 * 1/2003 Demkowski ..... F21L 4/00 362/102
6,979,100 B2 * 12/2005 Reiff ..... F21L 4/04 362/184
7,111,965 B2 * 9/2006 Hsu ..... F21L 4/06 362/191
7,195,222 B2 * 3/2007 Dent ..... E01F 9/635 248/511
7,370,989 B2 * 5/2008 Bayat ..... F21L 14/026 362/184
7,549,778 B2 * 6/2009 Chien ..... F21L 14/02 362/220
7,648,261 B2 * 1/2010 Ko ..... F21L 14/02 362/269
D620,634 S * 7/2010 Komar ..... D26/93
7,967,466 B2 * 6/2011 Chu ..... F21S 6/002 362/183
2003/0196393 A1 * 10/2003 Bowman ..... E01F 9/681 52/295
2009/0290335 A1 * 11/2009 Levine ..... F21V 17/007 362/220
2011/0222274 A1 * 9/2011 Ko ..... F21L 4/00 362/191
2012/0188776 A1 * 7/2012 Chen ..... F21L 4/005 362/396
2013/0258651 A1 * 10/2013 Buck ..... F21V 27/02 362/217.16
2015/0034506 A1 * 2/2015 Hwang ..... F21V 21/06 206/223

* cited by examiner

STAND FOR ELONGATED LIGHTING APPARATUS

CROSS-REFERENCE TO RELATED APPLICATIONS

This application claims priority to U.S. Provisional Application Ser. No. 62/105,408, filed Jan. 20, 2015, which is incorporated by reference herein in its entirety.

BACKGROUND

Elongated luminaires, including fluorescent lights and light emitting diode ("LED") lights are often permanently mounted in a particular location, such as under a cabinet or over a work bench, and are positioned to provide light to the area directly below the mounting position. These luminaires often have a cylindrical profile which causes the luminaire body to be unstable when not mounted to a surface, and thus positioning the luminaire such that it illuminates a selected area is difficult. For example, if a user positions the luminaire on a flat surface such that light is emitted toward a desired working position, the luminaire may roll and change the direction in which light is emitted in response to minor agitation.

Various elongated luminaires comprise integrated hook structures configured to support the luminaire in a hanging position. Although hanging the luminaire generally prevents the luminaire from significantly changing the direction in which light is emitted, such hook structures generally have limited use, as a selected area for use must have an accessible place in which the luminaire can be hung near the user's selected work area. Moreover, such designs generally do not allow the user to reposition the luminaire in order to best light the selected work area.

Therefore, a need exists for a repositionable mechanism for supporting an elongated luminaire in a selected position such that the luminaire illuminates a selected area.

SUMMARY

Embodiments of the present invention are generally directed to a multiple piece structure designed as a floor or wall stand that enables an elongated luminaire (e.g., a fluorescent or LED luminaire or portable light stick) or other device to stand upright or in a fixed position without the need to hold the luminaire or device (referred to as the luminaire herein). The luminaire could comprise an integrated power source (e.g., one or more batteries), and/or a power supply cord configured to electrically connect the luminaire to an external power source (e.g., AC power). In some embodiments, the floor or wall stand structure comprises three separate and connectable components. In other embodiments, the floor or wall stand comprises more or less than three separate and connectable components.

In general, the separate and connectable components may be configured to be connected to assemble the floor or wall stand structure in a sufficiently stable manner so as to support a luminaire and to be disassembled to provide for convenient portability of the floor or wall stand.

In various embodiments, the stand structure enables easy slide in insertion and/or removal of the luminaire. In various embodiments, the stand structure is configured for easy disassembly thereof such that the stand may be stored for use at a later time or in a different location. In some embodiments, the stand structure could also incorporate a hook design either integrated or separate from the floor or wall stand structure enabling the luminaire or portable light device to be hung from any structure to provide light when and where desired. In various embodiments, the stand structure with integrated or removable hook component could be utilized for an LED or fluorescent luminaire that can also be mounted under a cabinet, on a wall or ceiling if the stand structure or hook component is not utilized.

In one aspect of the present invention, a portable support stand for supporting an elongated luminaire. In an example embodiment, the portable support stand comprises a base portion configured to be positioned on a support surface and a luminaire holster detachably coupled to the base portion. The luminaire holster is configured to receive an elongated luminaire therein and to support the elongated luminaire in a fixed orientation relative to the support surface.

In another aspect of the present invention, a luminaire structure for supporting a luminaire on a support surface is provided. In an example embodiment, the luminaire structure comprises an elongated luminaire; a base portion configured to be positioned on a support surface; and a luminaire holster detachably coupled to the base portion. The luminaire holster is configured to receive the elongated luminaire therein and to support the elongated luminaire in a fixed orientation relative to the support surface.

In yet another aspect of the present invention, a method for using a luminaire structure is provided. In an example embodiment, the method comprises A method for using a luminaire structure, the method comprising: providing an elongated luminaire, a base portion comprising a first base component and a second base component, and a luminaire holster comprising a hollow holster body and a fastening mechanism. The example method further comprises placing a hollow holster body of the luminaire holster through a hole in a second base component; placing the hollow holster body of the luminaire holster through a hole in the first base component; sliding the first and second base components along the hollow holster body until at least one of the first and second base components is engaged by the fastening mechanism; and inserting the elongated luminaire into the hollow holster body.

BRIEF DESCRIPTION OF THE SEVERAL VIEWS OF THE DRAWINGS

Reference will now be made to the accompanying drawings, which are not necessarily drawn to scale, and wherein.

DETAILED DESCRIPTION

The present invention will now be described more fully hereinafter with reference to the accompanying drawings, in which some, but not all embodiments of the invention are shown. Indeed, the invention may be embodied in many different forms and should not be construed as limited to the embodiments set forth herein. Rather, these embodiments are provided so that this disclosure will satisfy applicable legal requirements. Like numbers refer to like elements throughout.

Various embodiments of the present invention are directed to a stand for an elongated luminaire. In various embodiments, the luminaire may have an at least substantially circular cross section along the length of a body portion of the luminaire. The elongated luminaire may comprise a housing having a driver (e.g., a ballast) and a lighting module (e.g., a fluorescent lighting module, an LED lighting module, an incandescent lighting module, and/or the like) located therein. The luminaire may additionally comprise one or more batteries within the housing configured to provide a power source for the driver and the lighting module. In various embodiments, the luminaire may be powered by an external power source (e.g., a 120V outlet), and thus a power cord may extend from the housing. Moreover, in various embodiments, the housing may comprise one or more extrusions extending therefrom, such as one or more mounting points configured to facilitate coupling of the luminaire to a separate object and/or surface.

Exemplary Elongated Luminaire

Figure 1:
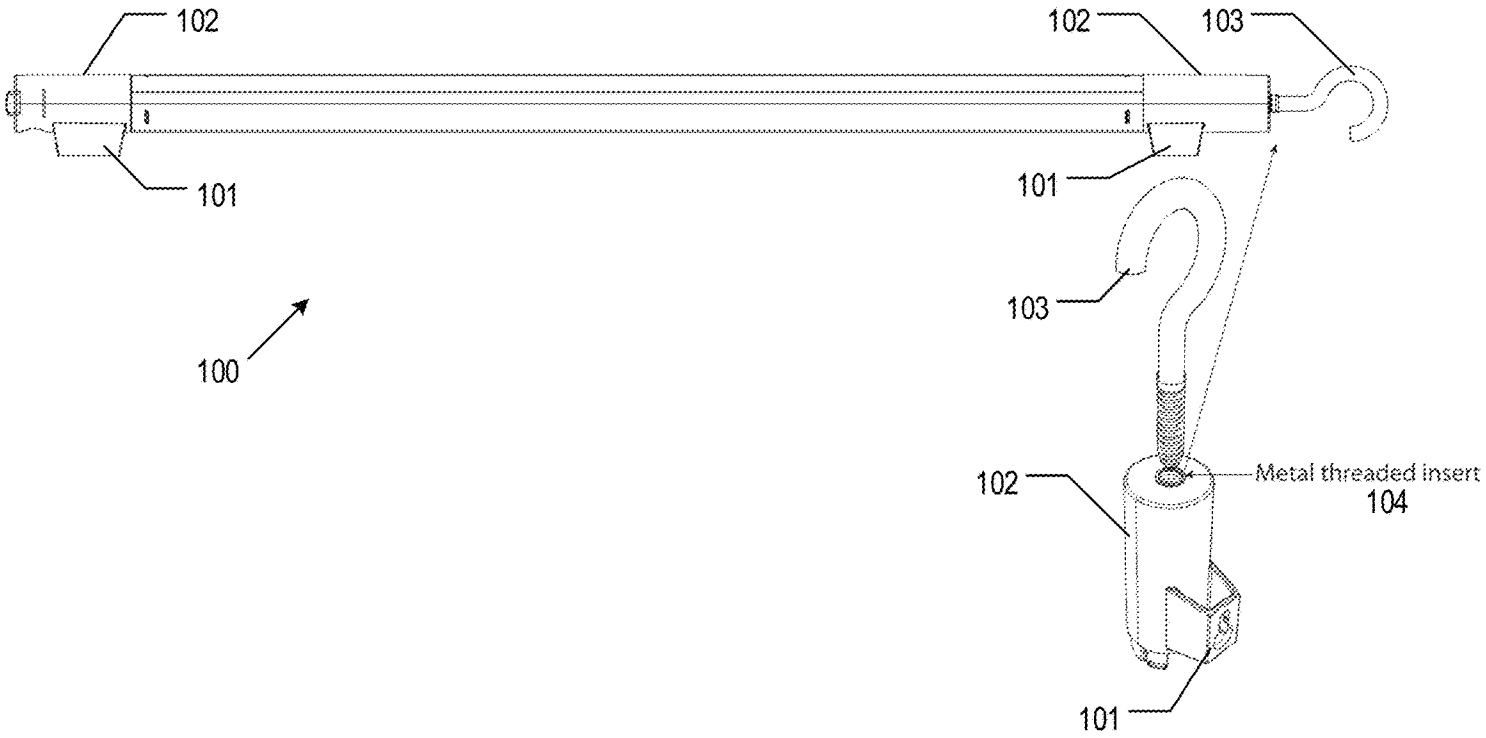
FIG. 1 shows a side view of a luminaire according to various embodiments of the present invention.
Figure 7:
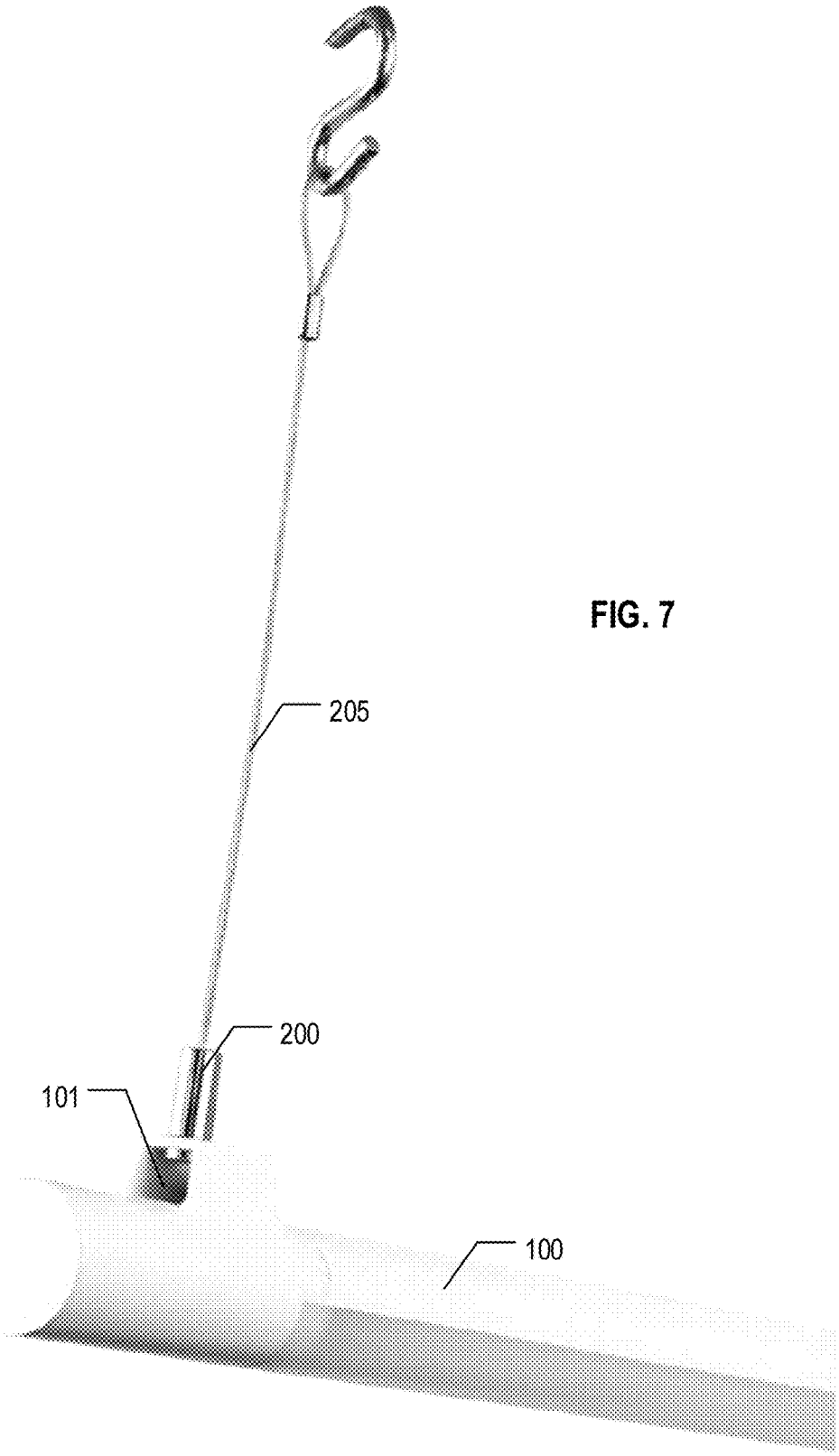
FIG. 7 shows a partial perspective view of a luminaire suspended via a mounting tab, in according to various embodiments of the present invention.

FIG. 1 illustrates an exemplary luminaire 100 having a plurality of mounting points 101 integrated as a part of end caps 102 disposed on each end of the elongated luminaire 100. Moreover, as illustrated in FIG. 1, the luminaire 100 may comprise a hook 103 to facilitate placement of the luminaire 100 when in use. The hook 103 may be detachably coupled to one or more end caps 102 via an attachment mechanism or otherwise secured thereto. As a non-limiting example, as illustrated in FIG. 1, the hook 103 may have threads disposed thereon that are configured to interact with corresponding threads associated with the end cap 102 (e.g., threaded insert 104). Thus, the hook 103 may be securely and detachably coupled to the end cap 102 of the luminaire 100. As yet another non-limiting example shown in FIG. 7, a hook assembly 200 may be detachably coupled to a mounting point 101 disposed on an end cap 102. For example, FIG. 7 illustrates an example of a hook assembly 200 secured to the mounting point 101 such that the luminaire 100 may be suspended from wire 205. As should be understood, the luminaire 100 that may be supported by the luminaire stand 1 may be configured to be mounted and/or suspended in various ways.

Examples of elongated luminaires that may be utilized in conjunction with the described luminaire stand are described in the U.S. Patent Application entitled "Linear LED Lamp Tube with Internal Driver and Interconnect to Line Voltage and Methods of Installing the Same" having Ser. No. 13/766,532, filed Feb. 13, 2013 and U.S. Patent Application entitled "Linear LED Lamp Tube with Internal Driver and Two- or Three-Prong Polarized Plug and Methods of Installing the Same" having Ser. No. 13/961,230 filed Aug. 7, 2013, each of which is incorporated herein by reference in their entirety.

In various embodiments, the luminaire 100 may be directional, such that light is emitted only in a desired direction relative to the luminaire 100. For example, the luminaire 100 may be configured to emit light in a lighting direction through a portion of elongated body. The lighting direction may encompass a portion of the perimeter of the luminaire 100, such that light is emitted in the lighting direction, and light is prevented from emission from other portions of the luminaire 100. For example, the luminaire 100 may comprise an opaque portion (e.g., a coating, a liner, and/or the like) configured to prevent light from emitting through a portion of the luminaire 100. In various embodiments, the interior of the opaque portion may be reflective and configured to reflect light away from the opaque portion and through the lighting direction. In various embodiments, the opaque portion may be aligned with the one or more mounting points 101, such that light is reflected through the lighting direction opposite the mounting points 101. In various embodiments, the opaque portion may occupy about half of the perimeter of the luminaire 100 (e.g., may extend about 180 degrees around the perimeter of the luminaire 100), and the lighting direction may correspondingly occupy the remaining about half of the perimeter of the luminaire 100. However, it should be understood that the opaque portion and the lighting direction may occupy various portions of the perimeter of the luminaire 100.

Exemplary Luminaire Stand

In various embodiments, the luminaire stand may comprise a base portion comprising one or more base components and a luminaire holster configured to be detachably coupled to the base portion. When assembled, the luminaire holster may be positioned at an acute angle relative to at least a portion of the base portion (i.e., less than 90 degrees), such that the luminaire stand is configured to support an elongated luminaire at an acute angle relative to a surface on which the stand is supported.

The luminaire holster may have an at least substantially cylindrical, hollow holster body having an interior diameter larger than the outside diameter of the elongated luminaire housing. The holster body may have an open panel configured such that a power cord and/or other extrusions extending away from the body of the luminaire may be positioned within the open panel when the luminaire is positioned within the luminaire stand.

In various embodiments, the luminaire stand may be configured to be disassembled to facilitate storage and transportation of the luminaire stand. Thus, the base portion and luminaire holster may each comprise one or more parts detachably coupled to one another. As will be described in greater detail herein, the base portion may comprise at least two base components configured to slide over the luminaire holster. The luminaire holster may comprise a fastening mechanism (e.g., comprising at least one resilient tab) configured to detachably secure the components of the base portion proximate a bottom surface of the luminaire holster.

Moreover, in various embodiments, the luminaire stand may comprise a hook or other attachment mechanism configured to facilitate attachment of the luminaire stand to external surfaces.

Figure 2:
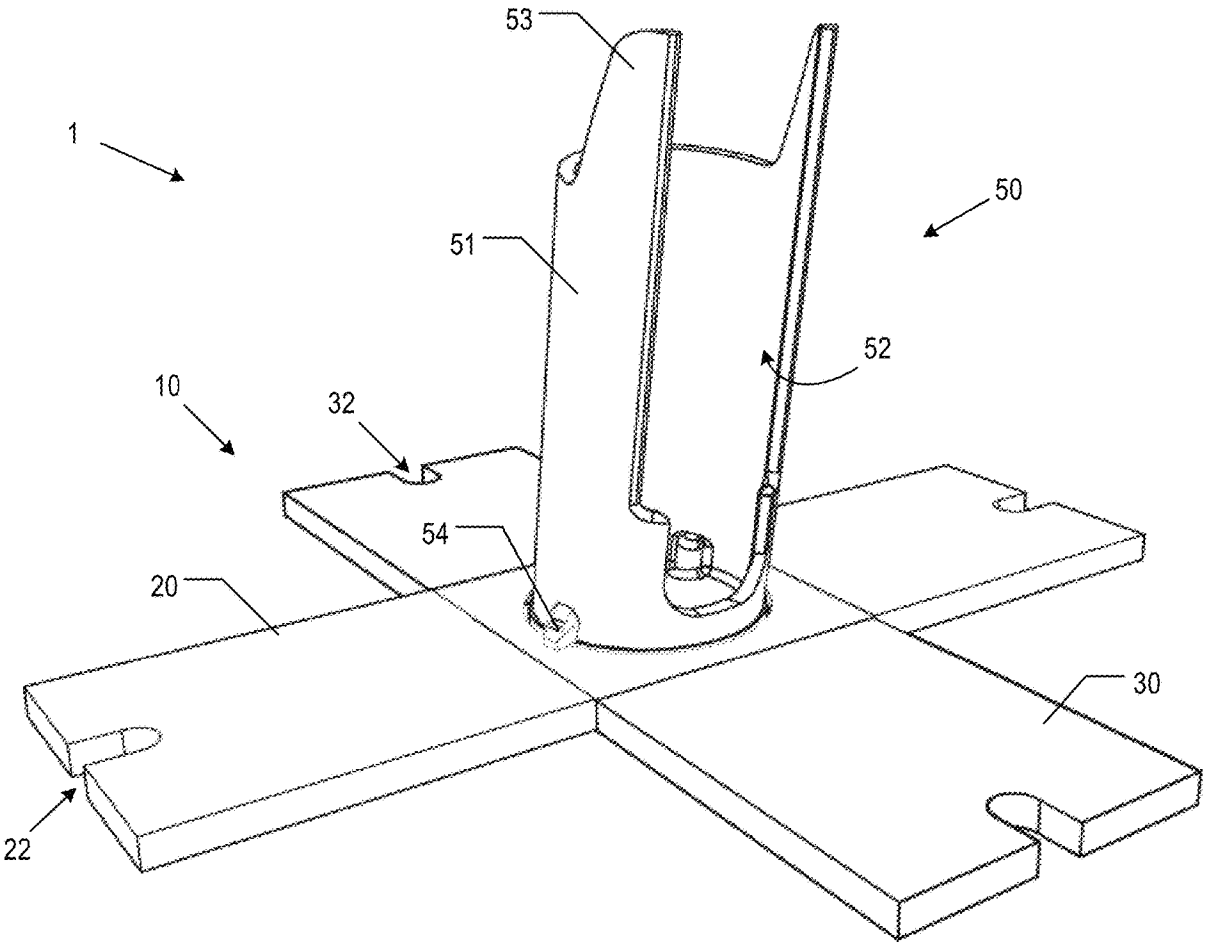
FIG. 2 shows a perspective view of an assembled luminaire stand according to various embodiments of the present invention.

Referring now to FIG. 2, a luminaire stand 1 according to various embodiments of the present invention may comprise a base portion 10 and a luminaire holster 50. In various embodiments, luminaire stand 1 may comprise a plastic material, although any of a variety of other materials (e.g., aluminum, steel, other metals, composites, rubber, and/or the like) may be used.

The base portion 10 may be at least substantially planar, and configured to be positioned on a support surface (e.g., a table or desk, the floor or ground, a wall or other surface). The luminaire holster 50 may be positioned at least substantially in the center of the base portion 10, and may extend away from the base portion in a direction away from the support surface. For example, the base portion 10 may define a plane and the luminaire holster 50 may extend out of the plane defined by the base portion 10.

The base portion 10 may have a center portion with a plurality of supports extending away from the center portion at regular intervals. For example, as illustrated in FIG. 2, the base portion may comprise a square central portion with four rectangular supports extending therefrom on each side of the square central portion. However, any of a variety of support configurations are within the scope of the invention, such as three supports extending away from the central portion, or five or more supports extending away from the central portion. Alternatively, the base portion may comprise a single support having a surface area substantially larger than the outside diameter of the luminaire holster. As non-limiting examples, the base portion may have a square, circular, or triangular shape from which the luminaire holster extends.

Referring again to FIG. 2, the base portion may comprise a plurality of base components, such as a first base component 20 and a second base component 30. The plurality of base components may each have a bottom surface positioned adjacent a support surface when the luminaire stand 1 is placed thereon, and a top surface opposite the bottom surface. In various embodiments, the base components 20, 30 may comprise one or more fastener openings 22, 32 such as slots or holes extending from the top surface to the bottom surface such that separate fasteners (e.g., screws, bolts, nails, clips, magnets, and/or the like) may be used to secure the luminaire stand 1 to a surface. As a non-limiting example, the fastener openings 22, 23 may facilitate securing the luminaire stand 1 to a vertical surface (e.g., a wall or the like).

As previously noted, the luminaire holster 50 may extend away from the base portion 10 perpendicular to the base portion (e.g., normal to the plane defined by the base portion). However, referring momentarily to FIG. 6B, which illustrates a side view of a luminaire stand 1 supporting a luminaire 100, the luminaire holster 50 may extend away from the base portion 10 such that an angle $\alpha$ exists between the luminaire holster 50 and at least a portion of the base portion 10. In various embodiments, the angle $\alpha$ is measured from the holster 50 to a plane parallel to the plane defined by the support surface upon which the luminaire stand 1 is placed or to the base of the luminaire stand 1 in the direction in which light is to be emitted from the luminaire 100. For example, in FIG. 6B, the angle $\alpha$ is measured from the holster 50 to a plane parallel to the support surface in the direction that the light ray 110 is emitted. In various embodiments, the angle $\alpha$ is an acute angle. In other embodiments, the angle $\alpha$ may be an obtuse angle. In various embodiments, this acute angle $\alpha$ is between 0° and 90°, and preferably between 45° and 90°. In various embodiments, the angle may be configurable or selectably adjustable. In other embodiments, the angle is fixed and/or predetermined.

Referring again to FIG. 2, the luminaire holster 50 may be substantially cylindrical, having an interior surface and an exterior surface and corresponding interior diameter and exterior diameter. The luminaire holster may have an open panel 52 extending from the exterior surface to the interior surface such that a power cord 105 or other extrusions on the luminaire 100 may be positioned therein when the luminaire is placed in the luminaire stand 1 (see FIG. 6A). Moreover, as shown in FIG. 2, the luminaire holster 50 may comprise one or more support flanges 53 configured to provide additional support to a luminaire 100 placed within the luminaire holster 50. In embodiments wherein the luminaire holster 50 is oriented at an acute angle $\alpha$ relative to the base portion 10, the one or more support flanges 53 may be positioned on a side of the luminaire holster 50 corresponding to the acute angle, such that a luminaire 100 placed within the luminaire holster 50 is supported at least in part by the one or more support flanges 53. The one or more support flanges 53 may comprise extensions of the holster body of the luminaire holster 50 extending above an upper edge of the luminaire holster 50 and extending only partially around the perimeter of the luminaire holster 50, such that the one or more support flanges 53 do not impede light emitted from the luminaire 100.

As will be described in greater detail herein, the luminaire holster 50 may comprise a fastening mechanism configured to detachably couple the luminaire holster 50 and the one or more components of the base portion 20, 30, such as one or more resilient tabs 54 as illustrated in FIG. 2. The resilient tabs 54 may each comprise a ledge on a bottom surface of the resilient tab 54 and a sloped surface opposite the ledge. When assembled, the resilient tabs 54 may be in a neutral position at which the ledge is positioned above and adjacent the top surface of the base portion 10 such that the various components of the base portion 10 are prevented from moving vertically along the length of the luminaire holster 50. The fastening mechanism (e.g., resilient tabs 54) prevent the need for other fasteners to secure the one or more components of the base portion 20, 30 to the luminaire holster 50, thereby reducing the need for extra pieces that may become lost.

Figure 3:
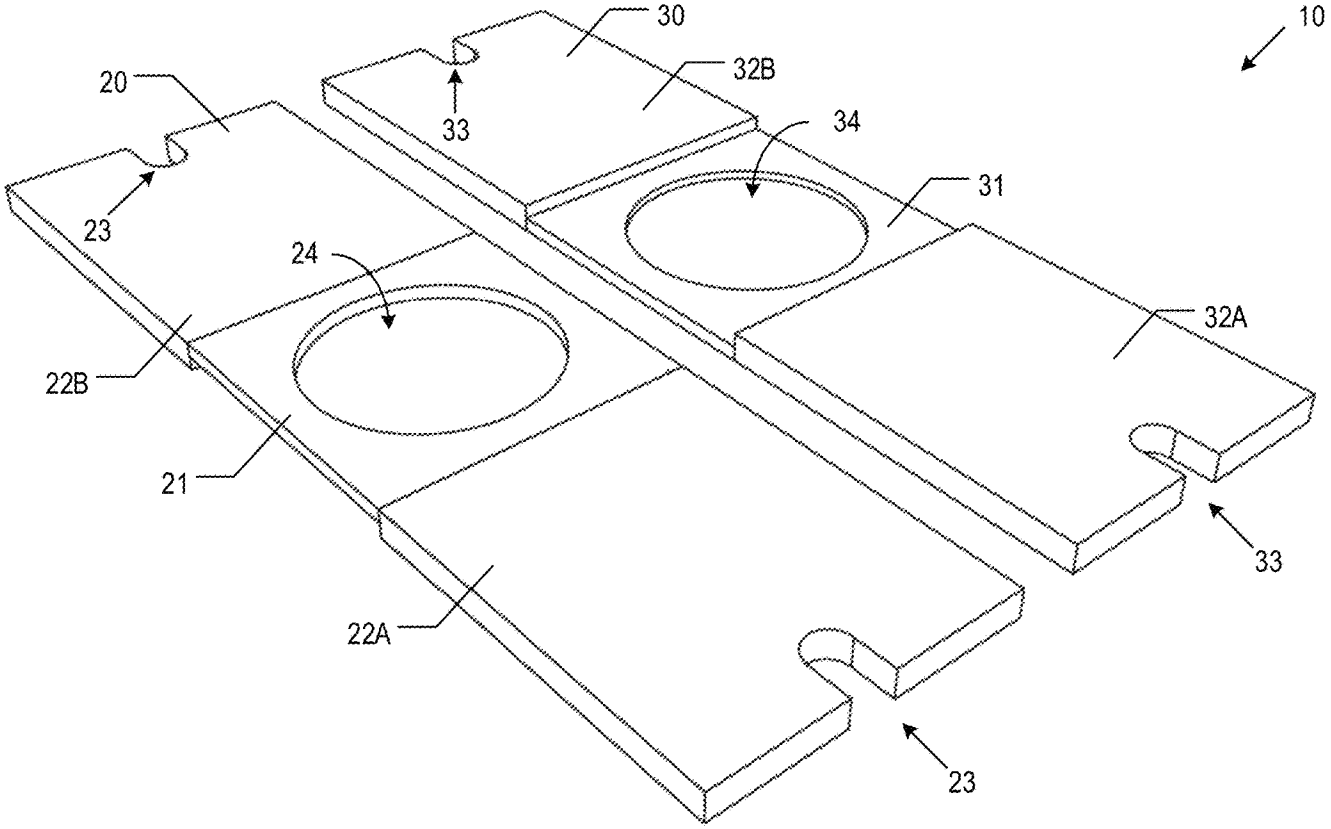
FIG. 3 shows a top perspective view of various components of a base portion of a luminaire stand according to various embodiments of the present invention.

FIG. 3 is a top perspective view of the first base component 20 and second base component 30. As shown in FIG. 3, the base components 20, 30 may be at least substantially rectangular having a top surface, a bottom surface opposite the top surface, and a thickness measured between the top surface and the bottom surface. Each of the base components 20, 30 may have a length measured parallel to the longitudinal axis of the base component 20, 30, and a width measured perpendicular to the length. As a non-limiting example, the base components may be sized to provide a stable support base for a luminaire 100 disposed therein. The base components 20, 30 may each have a rectangular (e.g., square) central portion 21, 31 and one or more supports 22A, 22B, 32A, 32B. As previously indicated, the base components 20, 30 may comprise one or more fastener openings 23, 33 configured to facilitate securing the luminaire stand 1 to a surface. As illustrated in FIG. 3, the fastener openings 23, 33 may be slots extending from an edge of the supports 22A, 22B, 32A, 32B and toward a central portion 21, 31 of the base components 20, 30.

In various embodiments, the size and/or weight of the edge supports 22A, 22B, 32A, 32B may be configured to support, balance, and/or counteract the weight of luminaire 100 at the acute angle $\alpha$. For example, the edge supports on a side of the luminaire stand 1 that does not correspond to the acute angle $\alpha$ may be configured to balance and/or counteract the force and/or torque experienced by the luminaire 100 positioned within the luminaire stand 1 due to gravity. Thus, in some embodiments, the weight and/or size of the edge supports 22A, 22B, 32A, 32B may define a maximum length or weight of luminaire that may be effectively used with the luminaire stand 1. However, as noted above, in various embodiments, the base components comprise fastener openings 23, 33 configured to facilitate securing the luminaire stand 1 to a surface such that the edge supports 22A, 22B, 32A, 32B need not balance the weight of the luminaire 100. In such embodiments, the maximum length and/or weight of the luminaire 100 is relevant only to determining if the luminaire stand 1 need be secured to the surface via the fastener openings 23, 33.

In various embodiments, multiple sets of base components 20, 30 and/or holsters 50 may be provided. For example, each set of base components 20, 30 may have edge supports 22A, 22B, 32A, 32B of different sizes and configured to enable the use of the luminaire stand 1 with different size luminaires 100. For example, a first set of base components 20, 30 may have edge supports 22A, 22B, 32A, 32B that are larger/longer/heavier than those of a second set of base components. The first set of base components 20, 30 may be configured for use with a larger/longer/heavier luminaire 100 than the second set of base components. In another example, a first holster 50 may have a hollow holster body 51 that has a greater diameter and/or that is configured to extend further along the length of the luminaire 100 than a second holster 50. Thus, the first holster 50 may be configured for use with a larger/longer/wider luminaire 100 than the second holster 50.

Accordingly, each set of base components 20, 30, and holster 50 may be configured such that the combined center of gravity of the luminaire 100 and the luminaire stand 1 (while the luminaire 100 is positioned within the holster 50 as described herein) remain directly above an area defined by a perimeter 60 (shown as the dashed line in FIG. 6A) bounding the base components 20, 30 (e.g., such that the perimeter of the area is aligned with the outer most edges of the base components 20, 30) to support the luminaire 100 in the desired position. Thus, for example, luminaire stand 1 comprising base components 20, 30 having longer edge supports 22A, 22B, 32A, 32B may be configured to support a longer luminaire 100 and/or a luminaire 100 oriented at a smaller acute angle $\alpha$ (i.e., approaching 45 degrees and/or approaching 0 degrees), because the combined center of gravity of the luminaire 100 and the luminaire stand 1 would remain above the an area defined by a perimeter 60 bounding the base components 20, 30, as the combined center of gravity of the luminaire 100, the base components 20, 30, and holster 50 move away from a central vertical axis aligned with the center of the base components 20, 30 and normal to a plane defined by the base components 20, 30, and/or the support surface. Similarly, a luminaire stand 1 comprising heavier base components 20, 30 and/or holster 50 may be configured to support a longer luminaire 100 and/or a luminaire 100 oriented at a smaller acute angle $\alpha$ (i.e., approaching 45 degrees and/or approaching 0 degrees), because the combined center of gravity of the luminaire 100 and the luminaire stand 1 would remain proximate the central vertical axis aligned with the center of the base components 20, 30 and normal to a plane defined by the base components 20, 30, and/or the support surface, and would thereby remain above an area defined by a perimeter bounding the base components 20, 30. For example, a line that is normal to a plane defined by the base components 20, 30, and/or the support surface and that passes through the combined center of gravity of the luminaire 100 and the luminaire stand 1 would also pass through area defined by perimeter 60.

In various embodiments, the center of gravity of the luminaire 100 may be located at a distance from the luminaire stand 1. For example, if the luminaire stand 1 is resting on the floor or a table/desk, the center of gravity of the luminaire 100 (and consequently the combined center of gravity of the luminaire 100 and the luminaire stand 1) may be located above the luminaire stand 1. For example, the center of gravity of the luminaire 100 may be spaced apart from the holster 50, the base components 20, 30, and/or other component of the luminaire stand 1.

In various embodiments, the central portions 21, 31 of the base components 20, 30 may be configured to interlock to form the base portion 10. The central portions 21, 31 may have a thickness substantially equal to half the thickness of the base components 20, 30. As shown in FIG. 3, the central portion 21 of the first base component 20 may have an top surface even with (i.e., within the same plane as) the top surface of the first base component 20, and may have a bottom surface located halfway between the top surface and the bottom surface of the first base component 20.

The central portion 31 of the second base component 30 may correspond with the central portion 21 of the first base component 20 such that the top surface of the second base component 30 is even with the top surface of the first base component 20 when the central portion 21 of the first base component 20 is over the central portion 31 of the second base component 30.

As illustrated in FIG. 3, the central portions 21, 31 of the base components 20, 30 each comprise a hole 24, 34 extending therethrough. The holes 24, 34 each have interior walls and have equal diameters such that the interior wall of the hole 24 through the first base component 20 is even with the interior wall of the hole 34 through the second base component 30 when the base components 20, 30 are assembled (see FIGS. 2 and 5). The diameter of the holes 24, 34 are larger than the exterior diameter of the luminaire holster 50, and configured such that the luminaire holster 50 may be positioned within the holes 24, 34 and the fastening mechanism may secure the base components 20, 30 and the luminaire holster 50 when each of the components are assembled to form the luminaire stand 1.

Figure 4:
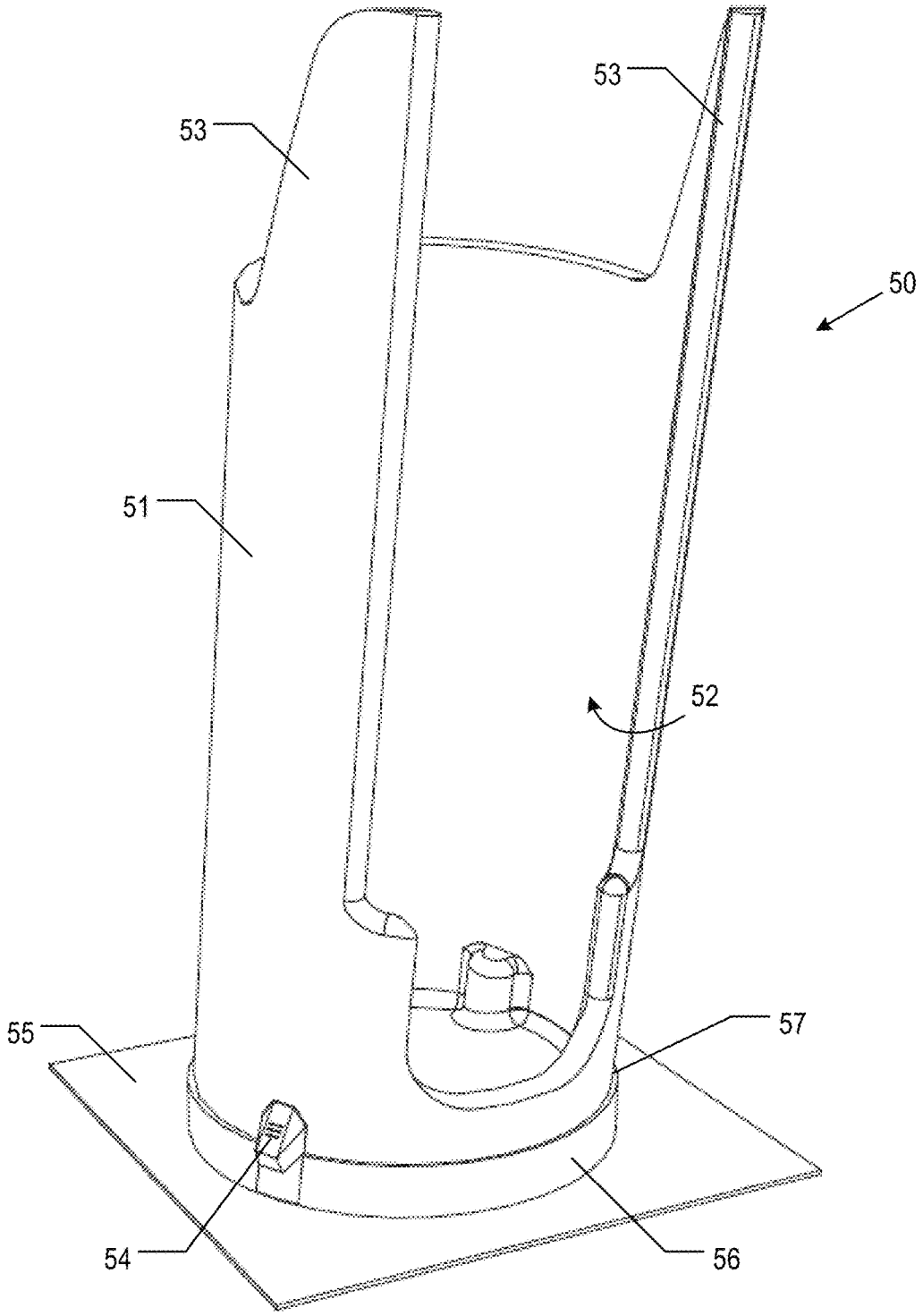
FIG. 4 shows a perspective view of a luminaire holster of a luminaire stand according to various embodiments of the present invention.

Referring now to FIG. 4, which illustrates a perspective view of a luminaire holster 50 according to various embodiments, the luminaire holster 50 may be configured to support a luminaire 100 therein. As previously indicated, the luminaire holster 50 may comprise a hollow holster body 51 having an interior diameter larger than the outside diameter of the body of a luminaire 100 to be supported therein. The hollow holster body 51 may comprise an interior cavity defined by the interior diameter and configured to receive a portion of an elongated luminaire 100 therein. The luminaire holster 50 may also comprise a base flange 55 coupled to the holster body 51 proximate a bottom portion of the holster body 51 by joint 57. Moreover, the luminaire holster 50 may have an interior height measured between an interior bottom surface of the luminaire holster 50 and a top edge of the luminaire holster 50. Moreover, as previously indicated, the luminaire holster 50 may have one or more support flanges extending above the top surface of the luminaire holster 50 and configured to support a portion of the luminaire 100 when positioned within the luminaire stand 1.

In various embodiments, the luminaire holster 50 may be configured such that a luminaire 100 positioned within the luminaire holster 50 maintains its position therein based on the force of gravity. However, in various embodiments, the luminaire holster may comprise a luminaire retaining mechanism configured to retain the luminaire 100 therein. As a non-limiting example, the interior bottom surface of the luminaire holster 50 may comprise a through hole extending therethrough. The through hole may be configured such that the luminaire 100 may be coupled to the luminaire holster 50 using one or more fasteners. Referring briefly to FIG. 1, a fastener (e.g., a screw, bolt, and/or the like) may be positioned to extend through the interior bottom surface of the luminaire holster 50 and to detachably engage the threaded insert 104 of the luminaire, and thereby couple the luminaire 100 to the luminaire holster 50.

Referring again to FIGS. 2 and 4, the luminaire holster 50 may comprise a fastening mechanism configured to detachably couple the luminaire holster 50 and the base portion 10. Moreover, the base flange 55 of the luminaire holster 50 may be larger than the diameter of the holes 24, 34 of the base components 20, 30 such that the bottom portion of the holster body 51 is prevented from moving through the holes 24, 34 of the base components 20, 30. Thus, in various embodiments the fastening mechanism may secure the base portion 10 between the base flange 55 and the fastening mechanism of the luminaire holster 50. As illustrated in FIG. 4, the holster body 51 may comprise a riser 56 located between the fastening mechanism and the base flange 55. In various embodiments, the holster body 51 is coupled to the riser 56 by joint 57. In various embodiments, the riser 56 may have a diameter larger than the exterior diameter of the remaining portion of the holster body 51. In such embodiments, the holes 24, 34 of the base components 20, 30 may have a diameter larger than the diameter of the riser 56. In various embodiments, the riser 56 may have a height at least substantially equal to the thickness of the base components 20, 30. Moreover, in embodiments in which the holster body 51 forms an acute angle with the base portion 10, the riser 56 may be perpendicular to the top surface of the base portion 10.

In the illustrated embodiment of FIG. 4, the fastening mechanism comprises a plurality of resilient tabs 54 each having a lower ledge and a sloped top surface. The resilient tabs 54 have a neutral position such that the tabs extend beyond the exterior surface of the holster body 51, and are configured to flex toward the interior of the holster body 51 such that the components of the base portion 10 may move past the resilient tabs 54 when the holster body 51 is positioned within the holes 24, 34 of the base components 20, 30.

As described above, in various embodiments, the angle $\alpha$ defined by the holster body 51 and a plane defined by the base components 20, 30 and/or the surface on which the luminaire stand 1 is positioned is predefined and fixed in some embodiments and selectably adjustable in some embodiments. Thus, in some embodiments, the joint 57 may comprise a junction between the riser 56 and the holster body 51 made via adhesive, welding, fasteners, or some other fixed method of securing the holster body 51 to the riser 56. In some embodiments, the riser 56 and the holster body 51 are integrally formed such that the joint 57 merely marks where the riser 56 ends and the holster body 51 begins. In other embodiments, the joint 57 may comprise a hinged or geared mechanism or other mechanism that allows the angle $\alpha$ to be selectably adjusted. In some embodiments, the joint 57 may be configured to allow a user to selectably adjust not only the angle $\alpha$ (e.g., the pitch angle) but also adjust the yaw and/or roll angle of the holster body 51 with respect to the base components 20, 30 and/or the surface on which the luminaire stand 1 is positioned. For example, in some embodiments, the joint 57 allows for universal selectable angles relative to 360 degrees about the holster and/or may allow the holster to be selectably adjusted with up to six degrees of freedom. In various embodiments, the joint 57 may further comprise a locking mechanism configured to cause the joint 57 to maintain the position selected by the user. Moreover, in various embodiments, the joint 57 is configured such that the combined center of gravity of the luminaire 100 and the luminaire stand 1 remain above an area defined by a perimeter 60 bounding the base components 20, 30 such that the luminaire 100 remains supported at any possible position of the joint 57. In such embodiments, the luminaire stand 1 may be configured relative to one or more particular luminaire 100 sizes and/or weights such that the degrees of freedom of the joint 57 ensure that the combined center of gravity of a luminaire 100 satisfying the luminaire size and weight considerations and the luminaire stand 1 remain above an area defined by a perimeter 60 bounding the base components 20, 30.

Figure 5:
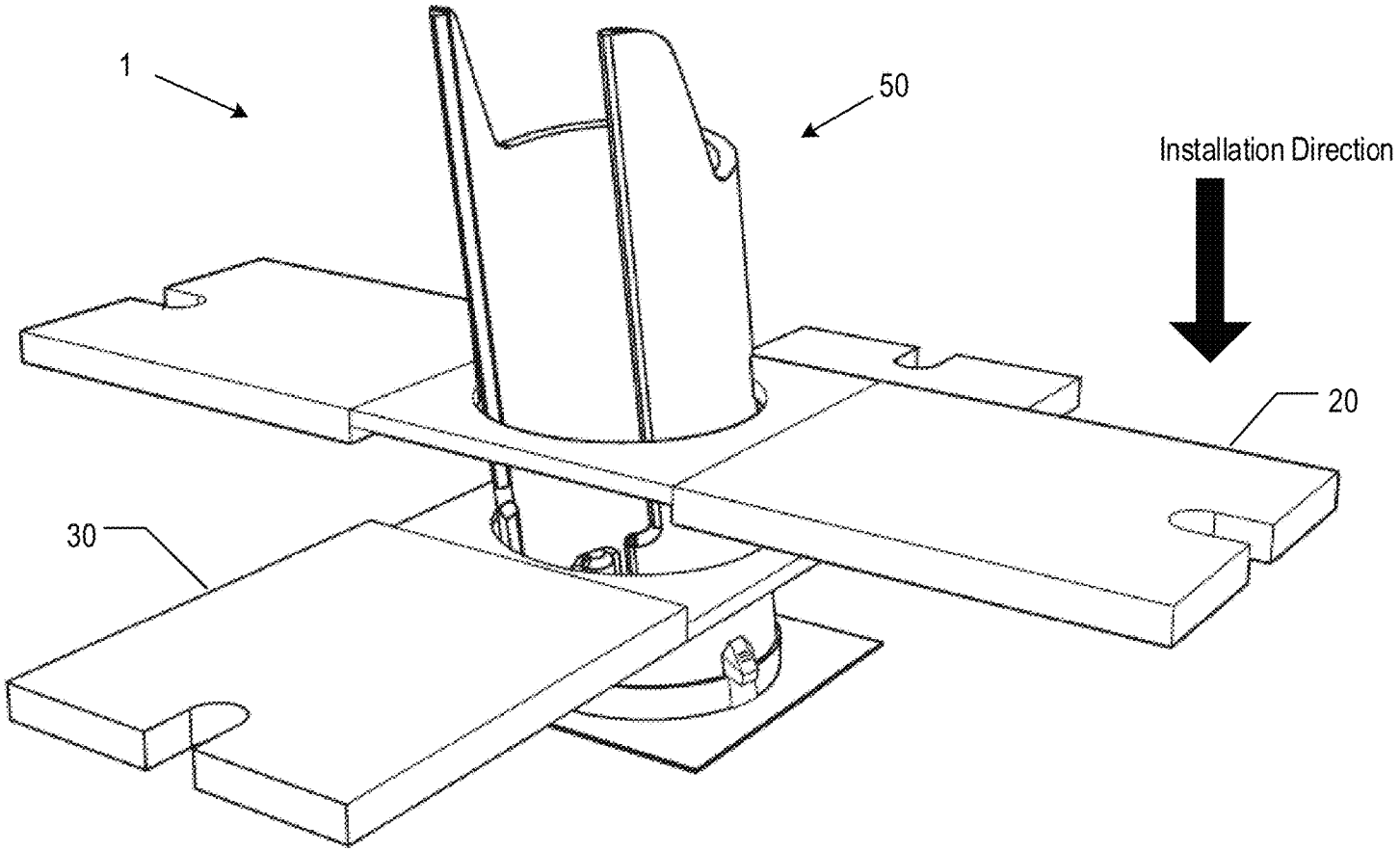
FIG. 5 illustrates an assembly process for forming a luminaire stand according to various embodiments.

FIG. 5 illustrates the various components of the luminaire stand 1 being assembled. As shown in FIG. 5, the second base component 30 is first placed over the luminaire holster 50 such that the holster body 51 is positioned within the hole 34 of the second base component 30. The second base component 30 is moved along the length of the holster body 51 in the direction of the installation direction arrow, until the bottom surface of the second base component 30 is adjacent the base flange 55, and the top surface of the second base component 30 is below the fastening mechanism. Similarly, the first base component 20 is placed over the luminaire holster 50 such that the holster body is positioned within the hole 24 of the first base component 20. The first base component 20 is moved along the length of the holster body 51 in the direction of the installation direction arrow, until the bottom surface of the central portion 21 of the first base component 20 is adjacent the top surface of the central portion 31 of the second base component 30 and the top surface of the first base component is below and adjacent to the fastening mechanism. In the illustrated embodiment of FIG. 5, moving the base components 20, 30 past the resilient tabs 54 in the installation direction pushes the resilient tabs toward the interior of the holster body 51 as a portion of the base components 20, 30 moves along the sloped surface of the resilient tabs 54. Once the base portions 20, 30 are past the resilient tabs 54, the tabs return to the neutral position, such that the lower ledge impedes motion of the base components 20, 30 in the direction opposite the installation direction.

To disassemble, the resilient tabs 54 are flexed toward the interior portion of the holster body 51 such that the base components 20, 30 are able to move past the resilient tabs 54 in the direction opposite the installation direction. The base components 20, 30 are then moved along the length of the holster body 51 until removed.

Figure 6A:
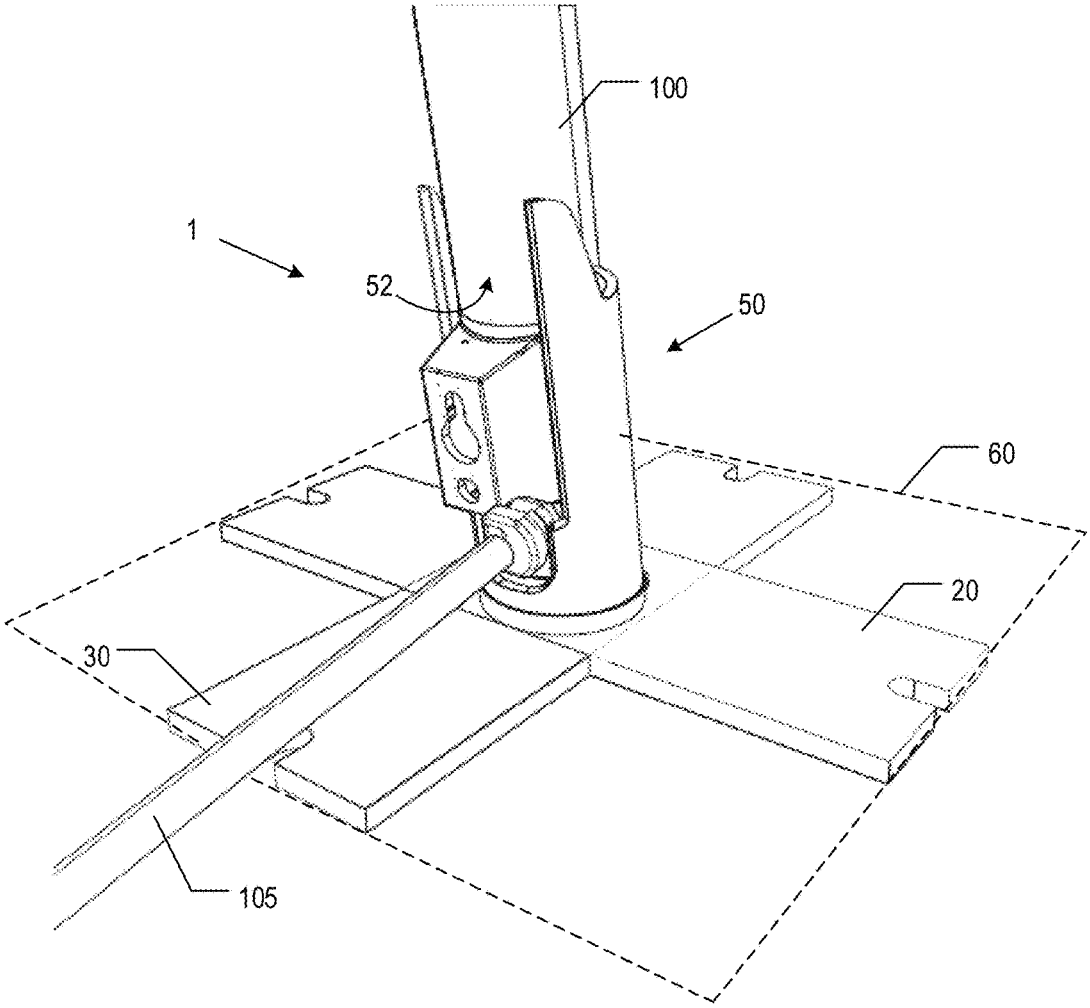
FIGS. 6A-6C show various views of a luminaire stand supporting a luminaire according to various embodiments of the present invention.
Figure 6B:
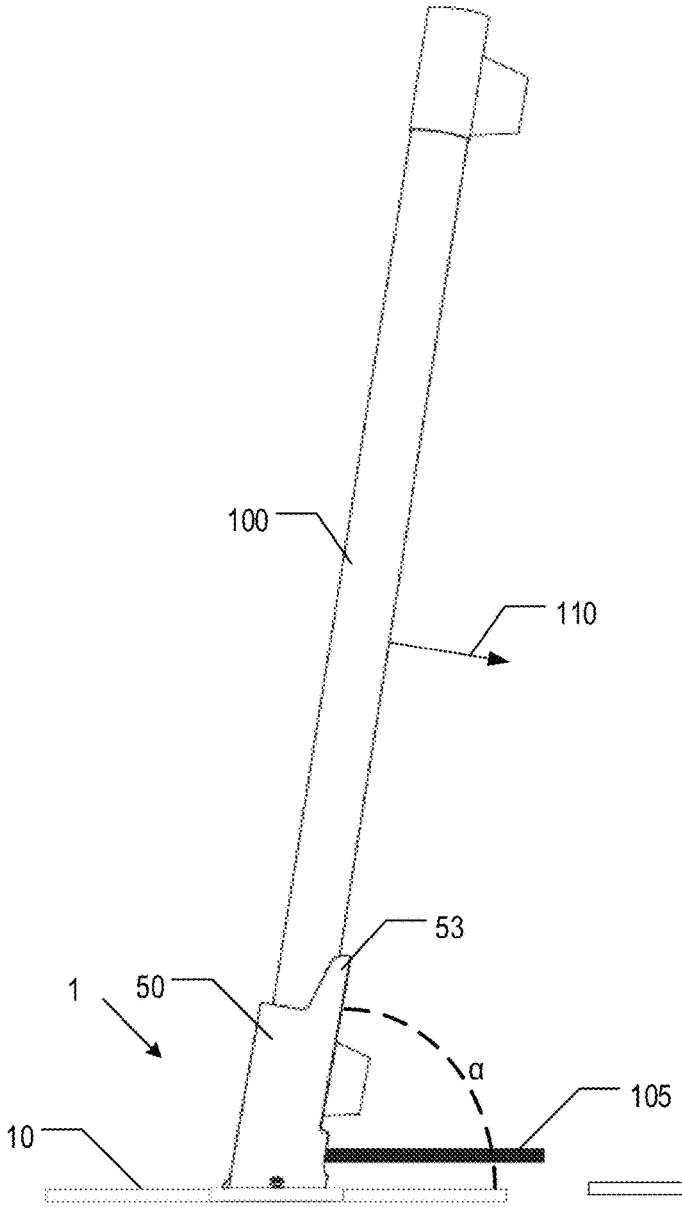
Figure 6C:
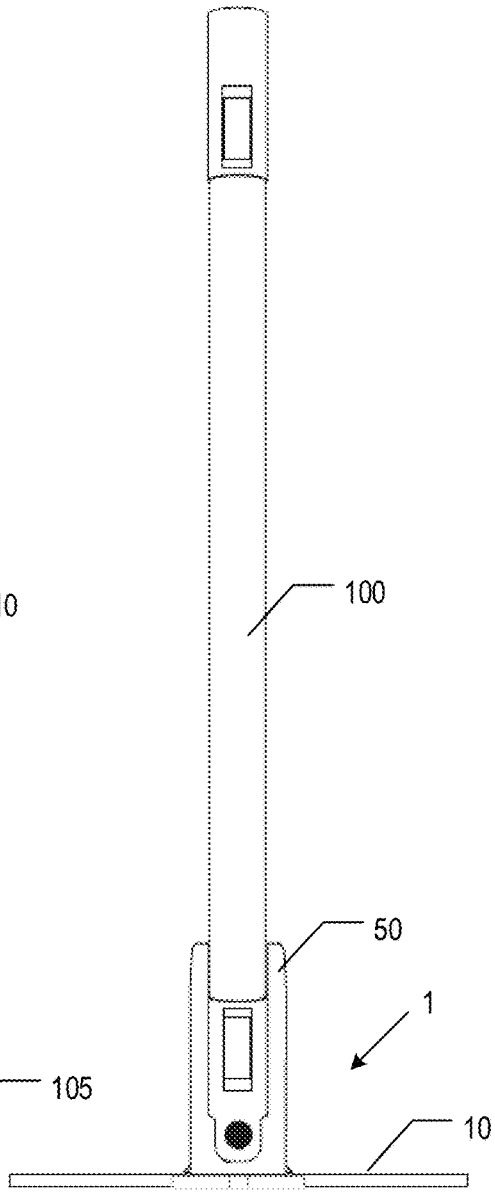

FIGS. 6A-6C illustrate various views of a luminaire 100 being supported by the luminaire stand 1 according to various embodiments of the present invention. Specifically, FIG. 6A is a close-up perspective view of the luminaire stand 1 supporting a luminaire 100. As shown in FIG. 6A, a cylindrical, elongated luminaire 100 is positioned within the holster body 51, with a power cord 105 and an extrusion positioned within the open panel 52.

FIGS. 6B and 6C illustrate various side views of a luminaire 100 positioned within the luminaire stand 1 according to various embodiments of the present invention. As shown in FIGS. 6B and 6C the luminaire 100 may be substantially longer than the luminaire stand 1, and the luminaire stand 1 may support the luminaire 100 at an acute angle relative to a support surface. By positioning the luminaire 100 at an acute angle relative to the support surface, the luminaire stand 1 may be used to hold a luminaire 100 such that the luminaire extends away from a vertical support surface, and may facilitate a useful positioning of the luminaire 100 such that light is emitted onto a selected area.

Many modifications and other embodiments of the inventions set forth herein will come to mind to one skilled in the art to which these inventions pertain having the benefit of the teachings presented in the foregoing descriptions and the associated drawings. As a non-limiting example, the luminaire holster 50 has been described as having a cylindrical body configured for supporting a luminaire 100 having a circular cross section. However, luminaires having any of a plurality of cross-section shapes may be supported by a luminaire stand according to various embodiments of the present invention, and the luminaire holster may thus comprise a body having a corresponding shape. As a non-limiting example, a luminaire having a square cross section may be supported by a luminaire stand having a square body. As will be understood by those skilled in the art, alternative luminaire holster body cross sections are also contemplated, such as the non-limiting examples of triangular, rectangular, and/or the like.

Moreover, in the pictured embodiments, the open panel 52 is positioned on the side of the luminaire holster 50 corresponding to the acute angle such that the support flanges 53 are positioned adjacent the open panel 52. Other embodiments are considered in which the open panel 52 is located on a side of the luminaire holster 50 that does not correspond to the acute angle. For example, the open panel 52 may be located on a side of the luminaire holster 52 that is opposite the side corresponding to the acute angle.

In embodiments in which the opaque portion of the luminaire 100 is aligned with the attachment members 101 of the luminaire 100, the luminaire stand 1 may be configured to direct the lighting direction away from the acute angle $\alpha$. Such configuration may thereby facilitate placement of the luminaire 100 to illuminate a desired area. However, in various embodiments, the acute angle $\alpha$, and the opaque portion of the luminaire 100 may be configured such that the lighting direction generally points toward the acute angle $\alpha$ to thereby illuminate, for example, a portion of the support surface proximate the luminaire base 1.

Figure 9:
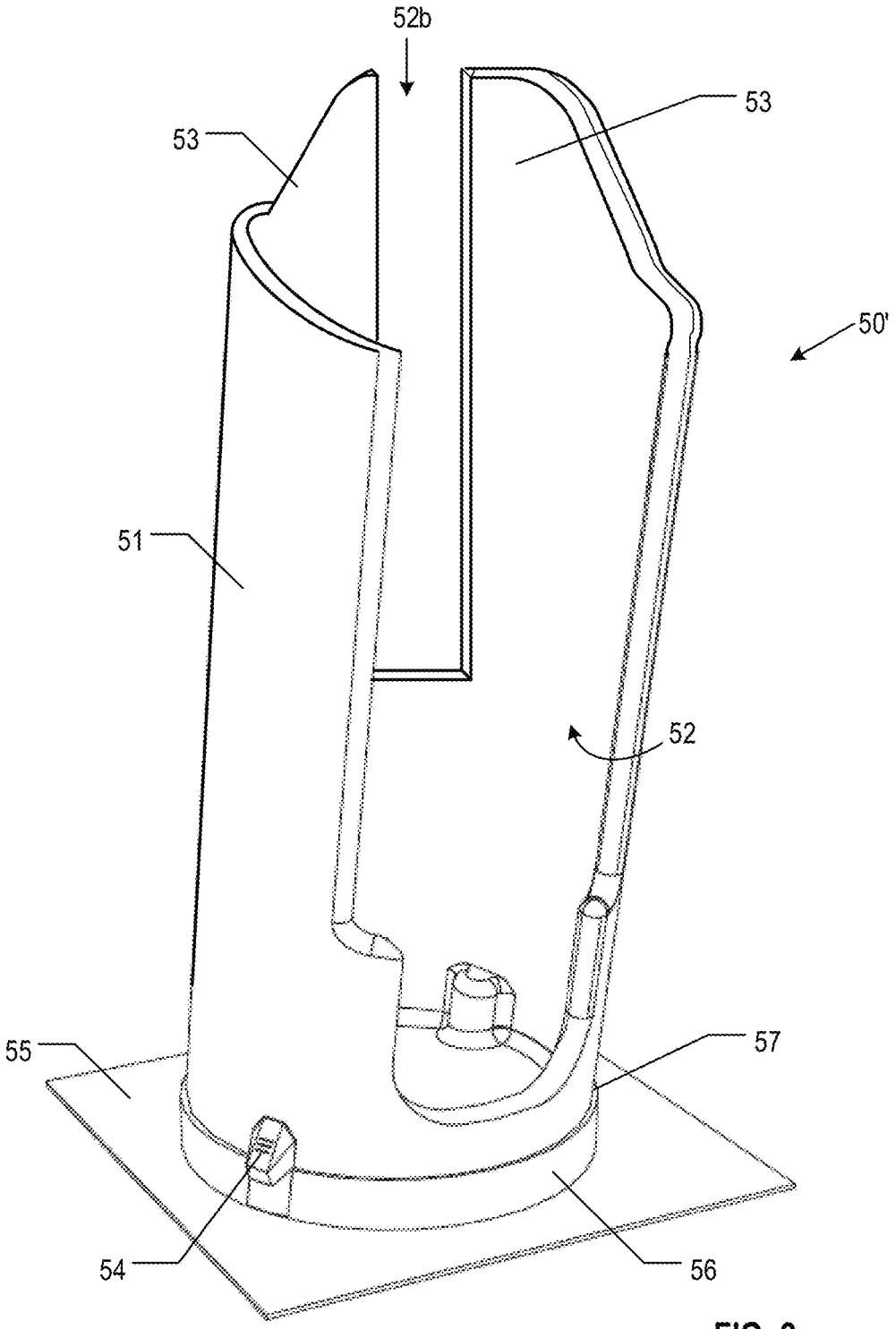
FIG. 9 shows a perspective view of an alternative embodiment of a luminaire holster of a luminaire stand.

FIG. 9 illustrates an alternative embodiment of a holster 50' having open panel 52 and a second open panel 52*b*. For example, in some embodiments, the luminaire 100 may have a power cord 105 or other extrusions that exit the side of the luminaire 100 opposite the light emitting portion of the luminaire. For example, the power cord 105 or other extrusions (e.g., mounting point 101) may extend outwardly from the opaque portion of the luminaire 100. The holster 50' is be configured to have the configured to have a power cord 105 or other extrusions on the luminaire 100 be positioned in open panel 52 when the luminaire is placed in the luminaire stand 1. The second open panel 52*b* is configured to allow light emitted by the luminaire 100 to pass therethrough.

As indicated above, the luminaire 100 may be configured to be mounted or hung in a variety of manners. For example, the luminaire 100 may comprise an integrated or removable hook (e.g., hook 103) from which the luminaire 100 may be hung. In another example, the luminaire 100 may comprise one or more mounting points 101 from which a hook assembly may be detachably coupled for hanging the luminaire 100.

Method for Using Luminaire Stand

Figure 8:
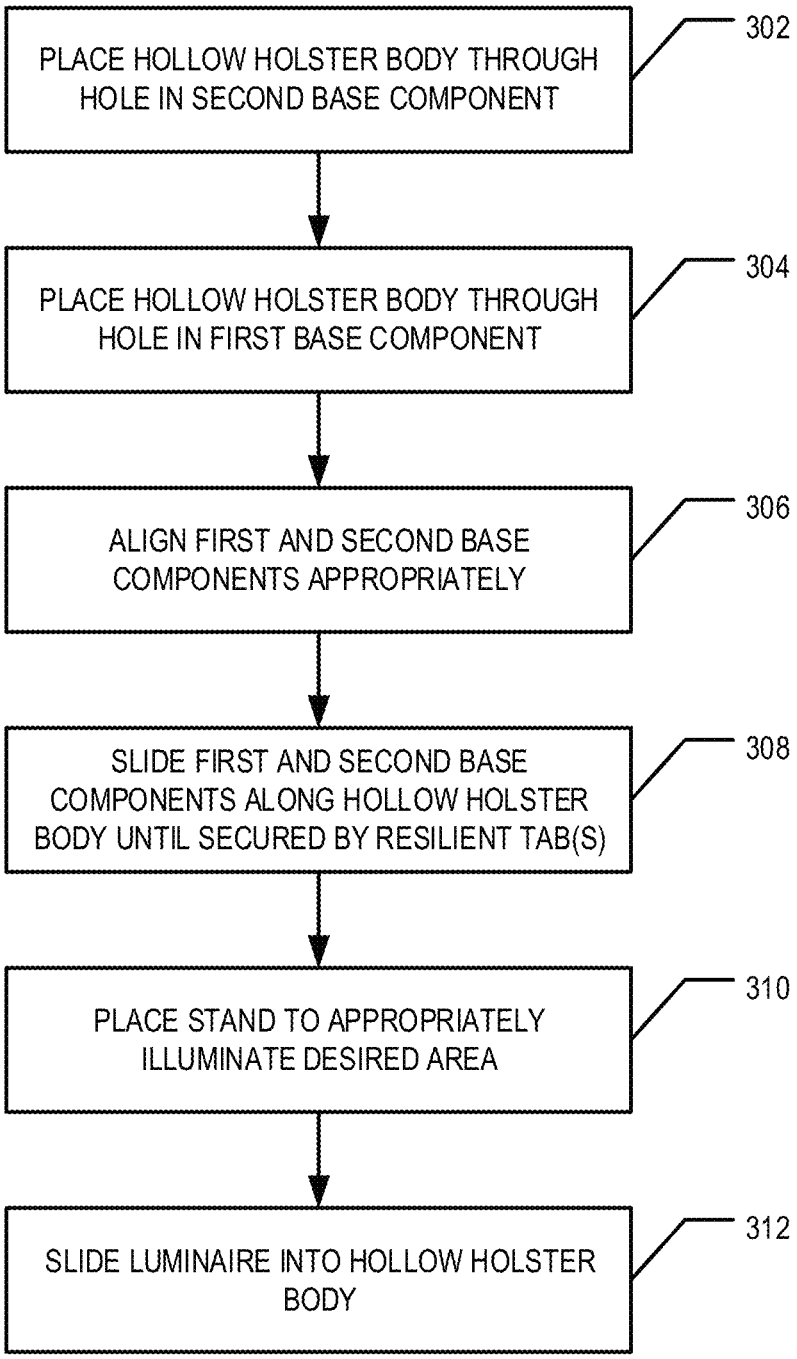
FIG. 8 provides a flowchart illustrating a method of using the luminaire stand according to various embodiments of the present invention.

FIG. 8 provides a flowchart illustrating a method of using a luminaire stand (e.g., luminaire stand 1). Starting at step 302, the hollow holster body 51 of the luminaire holster 50 is placed through the hole 34 of the second base component 30. For example, the user may position the second base component 30 such that the hollow holster body 51 passes through the hole 34. At step 304, the hollow holster body 51 is placed through the hole 24 in the first base component 20. For example, the user may position the first base component 20 such that the hollow holster body 51 passes through the hole 24. At step 306, the first and base components are aligned appropriately. For example, the user may align the first and second base components such that the central portions 21, 31 overlap appropriately. For example, the central portions 21, 31 of the base components 20, 30 may be aligned such that the central portions 21, 31 interlock to form a base portion 10. After completing step 306, the assembly may be similar to that shown in FIG. 5.

Continuing with FIG. 8, at step 308 the first and second base components 20, 30, are slid along the length of the hollow holster body 51 until the first and second base components are secured by at least one resilient tab 54. For example, the first and second base components 20, 30 may be slid along the length of the hollow holster body 51 until the riser 56 is positioned within the holes 24, 34 and/or the first and/or second base components 20, 30 are engaged by one or more resilient tabs 54. For example, the first base component 20 may be engaged by one or more resilient tabs 54 causing the first and second base components 20 to be secured between the base flange 55 and the one or more resilient tabs 54. After completing step 308, the assembly may be similar to that shown in FIG. 2.

Continuing to step 310 shown in FIG. 8, the luminaire stand 1 may be placed and/or secured in the appropriate location to illuminate the user's work area, and/or the like. For example, the user may place the luminaire stand 1 on a table, counter, and/or the like in the desired position. In another example, the user may secure the luminaire stand 1 to a wall or other vertical surface (e.g., by engaging fasteners within fastener openings 22, 23) such that the user's work area and/or the like may be illuminated.

At step 312, a luminaire 100 is slid into the luminaire stand 1. For example, the user may slide a luminaire 100 into the luminaire stand 1. The user may then turn on the luminaire 100 (e.g., via an on/off switch supplied thereby) to illuminate the desired work area. The location of the luminaire stand 1 may be modified as necessary to illuminate the user's work area and/or the like as desired. When the user is done using the luminaire 100, the user may follow a process similar to the reverse of the method of use illustrated by FIG. 8 to disassemble the luminaire stand 1 for storage and/or later use.

CONCLUSION

It is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A portable support stand for supporting an elongated luminaire, the portable support stand comprising:

a base portion configured to be positioned on a horizontal support surface; and a hollow luminaire holster offset at an acute angle relative to the base portion, having a circumference, and being detachably coupled to the base portion, at least a portion of the hollow luminaire holster being configured to receive the elongate luminaire within the circumference of the hollow luminaire holster and to support the elongated luminaire in a fixed orientation relative to the support surface, wherein:

the base portion comprises a hole extending there-through, when coupled relative to one another, at least a portion of the hollow luminaire holster extends through the hole in the base portion, the hollow luminaire holster comprises a holster body, one or more support flanges, a first open panel, and a second open panel that collectively define the circumference of the hollow luminaire holster, the first open panel defining a first opening, the second open panel defining a second opening;

the one or more support flanges extend beyond a first end of the holster body in an axial direction of the holster, the first end of the holster body being opposite a second end of the holster body positioned adjacent the base portion;

the holster body has a primary axis extending between the first end and the second end of the holster body;

the second opening is sized differently than the first opening, positioned circumferentially opposite the first opening, and positioned at least partially axially opposite the first opening; and the second opening and the first opening both extend from the second end of the holster body.

2. The portable support stand of claim 1, wherein the support surface defines a first plane parallel thereto and the acute angle of the hollow luminaire holster with respect to the first plane is greater than 0 degrees and approximately 90 degrees or less.

3. The portable support stand of claim 1, wherein the base portion comprises a first base component and a second base component, the first and second base components being configured to interlock.

4. The portable support stand of claim 1, wherein the luminaire holster comprises a fastening mechanism configured to detachably secure the base portion to the luminaire holster.

5. The portable support stand of claim 1, wherein the first opening of the first open panel is configured such that one of extrusions or a power cord from the elongate luminaire extend there-through.

6. The portable support stand of claim 1, wherein a cross-section of the luminaire holster is generally circular.

7. The portable support stand of claim 1, wherein an inner cavity of the luminaire holster is generally cylindrical.

8. The portable support stand of claim 1, wherein the luminaire holster comprises a riser, the riser having a height equal to the thickness of the base portion.

9. The portable support stand of claim 1, wherein the base portion comprises one or more fastener openings.

10. The portable support stand of claim 9, wherein the one or more fastener openings are slots.

11. A luminaire structure for supporting a luminaire on a support surface, the luminaire structure comprising:

an elongated luminaire;

a base portion configured to be positioned on a horizontal support surface; and a hollow luminaire holster offset at an acute angle relative to the base portion, having a circumference and being detachably coupled to the base portion, at least a portion of the hollow luminaire holster being configured to receive the elongated luminaire within the circumference of the hollow luminaire holster and to support the elongated luminaire in a fixed orientation relative to the support surface, wherein:

the base portion comprises a hole extending there-through, when coupled relative to one another, at least a portion of the hollow luminaire holster extends through the hole in the base portion, the hollow luminaire holster comprises a holster body, one or more support flanges, a first open panel, and a second open panel that collectively define the circumference of the hollow luminaire holster, the first open panel defining a first opening, the second open panel defining a second opening;

the one or more support flanges extend beyond a first end of the holster body in an axial direction of the holster, the first end of the holster body being opposite a second end of the holster body positioned adjacent the base portion;

the holster body has a primary axis extending between the first and second ends of the holster body;

the second opening is sized differently than the first opening, positioned circumferentially opposite the first opening, and positioned at least partially axially opposite the first opening; and the second opening and the first opening both extend from the second end of the holster body.

12. The luminaire structure of claim 11, wherein the elongated luminaire comprises a hook configured to support the luminaire structure.

13. The luminaire structure of claim 11, wherein the elongated luminaire is at least one of a fluorescent lamp or a light emitting diode (LED) lamp.

14. The luminaire structure of claim 11, wherein the elongated luminaire is generally circular in cross section and wherein the luminaire holster is generally circular in cross section.

15. The luminaire structure of claim 11, wherein the elongated luminaire comprises an elongated body and a power cord extending therefrom, wherein the first opening is configured for the power cord to pass there-through, and wherein the second opening is configured to allow light emitted by the elongated luminaire to pass there-through.

16. The luminaire structure of claim 11, wherein the support surface defines a first plane parallel thereto and the acute angle of the hollow luminaire holster with respect to the first plane is greater than 0 degrees and approximately 90 degrees or less.

17. The luminaire structure of claim 11, wherein:

the luminaire comprises one or more mounting points, the one or more mounting points configured for suspending the elongated luminaire therefrom, and the open panel of the luminaire holster is configured to allow the one or more mounting points to extend there-through.

18. A method for using a luminaire structure, the method comprising:

providing an elongated luminaire, a base portion comprising a first base component and a second base component, and a luminaire holster comprising a hollow holster body and a fastening mechanism;

placing the hollow holster body of the luminaire holster through a hole in a second base component;

placing the hollow holster body of the luminaire holster through a hole in the first base component;

sliding the first and second base components along the hollow holster body until at least one of the first and second base components is engaged by the fastening mechanism; and inserting the elongated luminaire into the hollow holster body.

19. The portable support stand of claim 1, wherein the one or more support flanges comprise at least a first flange and a second flange, the first flange and the second flange being positioned axially opposite one another on opposing circumferential edges of the second opening of the second open panel, the first flange and the second flange each at least partially defining the second opening.

20. The luminaire structure of claim 11, wherein the one or more support flanges comprise at least a first flange and a second flange, the first flange and the second flange being positioned axially opposite one another on opposing circumferential edges of the second open panel, the first flange and the second flange each at least partially defining the second opening of the second open panel.

* * * * *